United States Patent [19]

Sorensen et al.

[11] Patent Number: 5,005,449

[45] **Date of Patent: * Apr. 9, 1991**

[54] HAND TOOL OR IMPROVED BAR CLAMP

[75] Inventors: Joseph A. Sorensen; Dwight L. Gatzemeyer, both of Lincoln, Nebr.

[73] Assignee: Peterson Manufacturing Co., Inc., DeWitt, Nebr.

[ * ] Notice: The portion of the term of this patent subsequent to May 22, 2007 has been disclaimed.

[21] Appl. No.: 480,098

[22] Filed: Feb. 14, 1990

[51] Int. Cl.[5] ..... B25B 13/12; B25B 5/02

[52] U.S. Cl. ..... 81/152; 81/487; 81/182; 269/169

[58] Field of Search ..... 81/150, 152, 182, 487, 81/373; 269/6, 166–170

[56] References Cited

U.S. PATENT DOCUMENTS

| | | | |
|---|---|---|---|
| 753,837 | 3/1904 | Barcus | 81/152 |
| 1,739,488 | 12/1929 | Thayer | 269/166 X |
| 2,149,541 | 3/1939 | Nagle | 81/182 X |
| 3,096,975 | 7/1963 | Irwin | 269/169 |
| 4,563,921 | 1/1986 | Wallace | 81/373 |
| 4,926,722 | 5/1990 | Sorensen et al. | 269/166 X |
| 4,932,638 | 6/1990 | Chen | 269/6 |

*Primary Examiner*—James G. Smith

*Attorney, Agent, or Firm*—Lackenbach Siegel Marzullo & Aronson

[57] ABSTRACT

A hand tool or clamp, which is operable with one hand, includes a fixed jaw and a movable jaw. The movable jaw connects at one end to a movable slide bar. One way drive means, by operation of a trigger handle, releasably engages the slide bar with advances the movable jaw toward the fixed jaw or away from the fixed jaw. Disengagement of the one way drive means will allow for manual return movement of the movable jaw.

20 Claims, 8 Drawing Sheets

HAND TOOL OR IMPROVED BAR CLAMP

BACKGROUND OF THE INVENTION

This invention relates generally to a hand tool or a bar clamp of the type used to temporarily clamp together two articles, for example, for gluing, or to hold a workpiece for welding, and more particularly to a quick-action bar clamp wherein the moving jaw can be rapidly advanced or advances in small increments of selectable length.

Alternatively, the hand tool of the invention can be used as a spreader to spread apart elements of the same article or two separate articles. Rapid advancement of the movable jaw and firm grip makes it possible to use the hand tool as a wrench or a cutter.

In recent years, over-center toggle action handgrips have been incorporated for use in final tightening against the workpiece, for example, in U.S. Pat. No. 4,088,313 by Pearson and U.S. Pat. No. 4,563,921 by Wallace. A disadvantage in the prior art lies in the fact that adjustment in the moving jaw is cumbersome and imprecise. Frequently, the moving jaw is entirely disengaged and free to move until the final tightening of an object between the movable and fixed jaws is accomplished.

What is needed is a versatile hand tool having a moving jaw which is rapidly movable over distances to engage a workpiece and is operable using one hand with complete control by the operator at all times.

BRIEF DESCRIPTION OF THE DRAWINGS

Other advantages and features of the invention are described with reference to exemplary embodiments, which are intended to explain and not to limit the invention, and are illustrated in the drawings in which.

DESCRIPTION OF ILLUSTRATIVE EMBODIMENT

Although a specific embodiment of the invention will now be described with reference to the drawings, it should be understood that the embodiment shown is by way of example only and merely illustrative of but one of the many possible specific embodiments which can represent applications of the principles of the invention. Various changes and modifications, obvious to one skilled in the art to which the invention pertains are deemed to be within the spirit, scope and contemplation of the invention as further defined in the appended claims.

Figure 1:
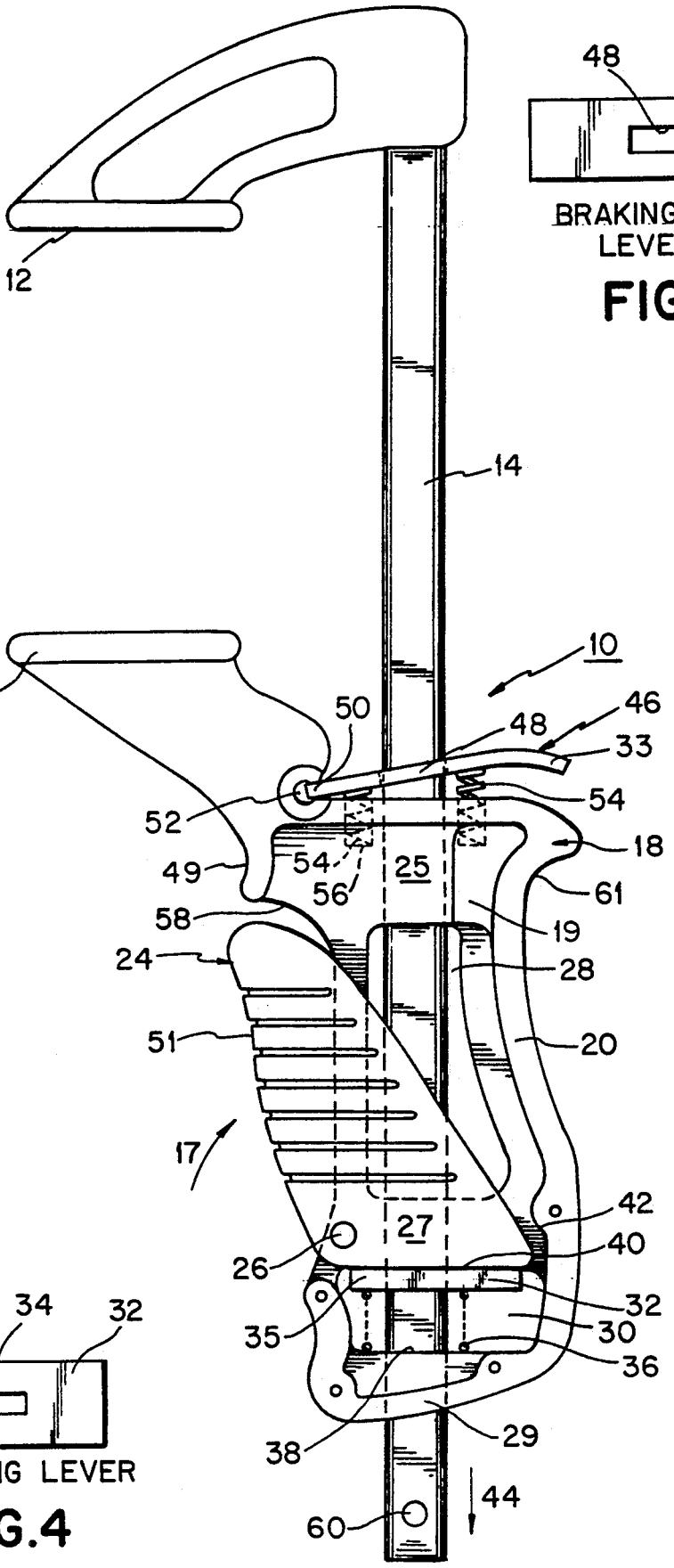
FIG. 1 is an elevational view of a hand tool.
Figure 3:
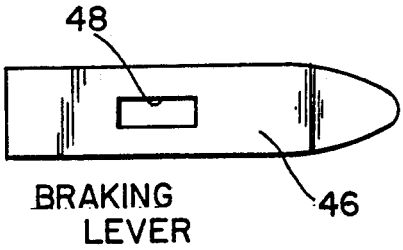
FIG. 3 is a plan view of the braking lever shown in FIG. 1.
Figure 4:
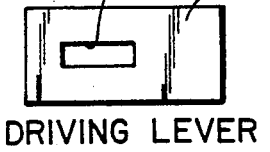
FIG. 4 is a plan view of the driving lever.
Figure 2:
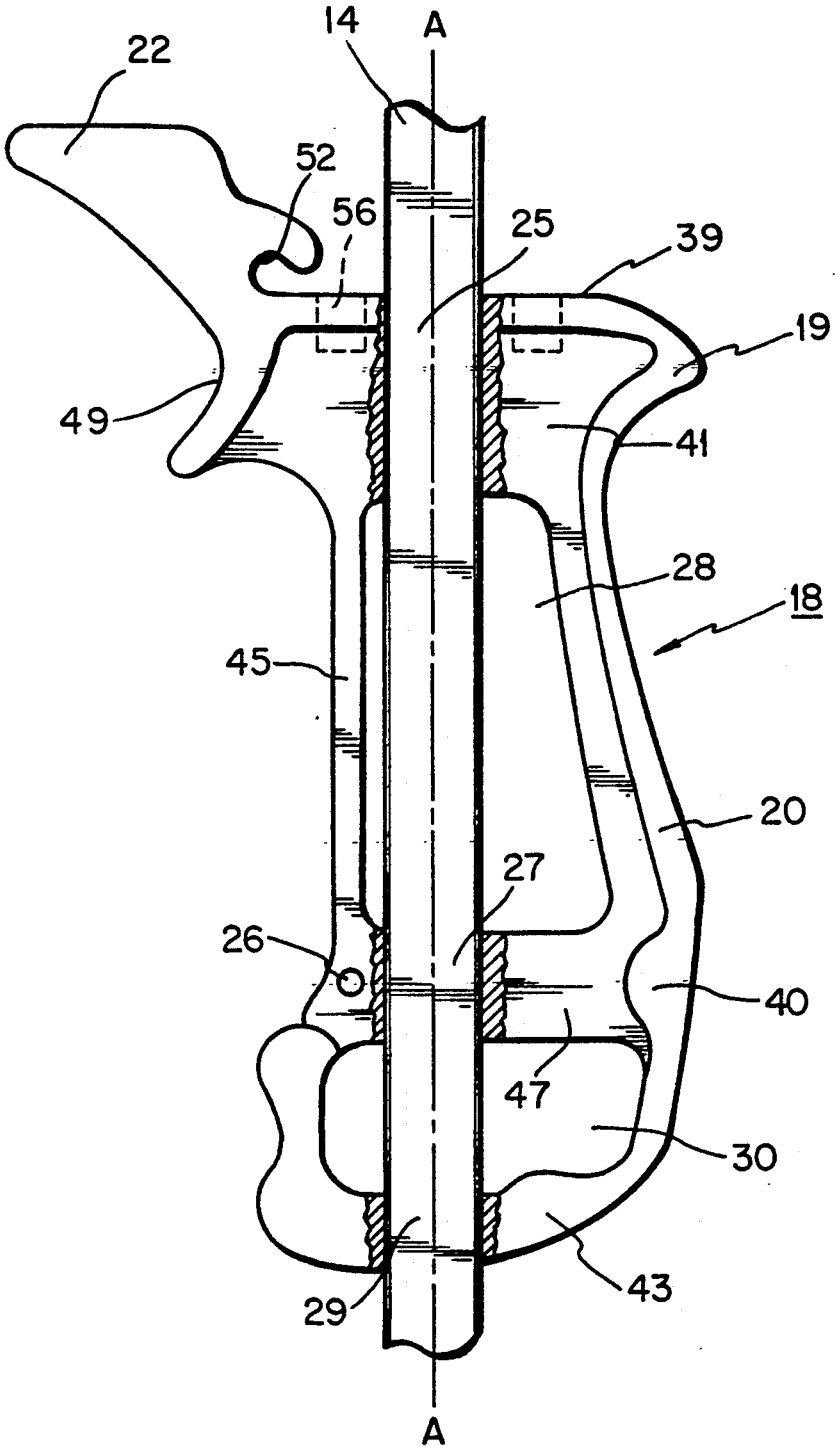
FIG. 2 is a partially sectional view of a support assembly.

Referring now to FIGS. 1 and 2, the hand tool or improved bar clamp of the invention is shown at 10 and includes a movable jaw 12 mounted to a slide bar 14. The slide bar is movable within openings 25, 27 and 29 of a support assembly or support means 18. A fixed jaw 22 opposing the movable jaw 12 extends outwardly from the support assembly.

The support assembly 18 which is more specifically shown in FIG. 2 has a body 19 with front 41 and rear 43 portions.

On one side, the front and rear portions are interconnected by a handgrip 20 which extends along a longitudinal axis A—A of the support assembly and the slide bar. Spaced from the handgrip is a first support element 45 interconnecting the other side of the front 41 and rear 43 portions. As shown in FIG. 2, the first support element 45 is substantially parallel to the longitudinal axis of the support assembly. However, other positions of the first support element are possible. An intermediate portion 47 is spaced between the front and rear portions and extends transversely to the handgrip and the first support element. The openings 25, 27 and 29 are situated correspondingly within the front, intermediate and rear portions.

FIGS. 1 and 2 illustrate that the longitudinal axis A—A of the slide bar is substantially parallel and/or coincides with the longitudinal axes of the openings 25, 27 and 29. In the support assembly 18 the slide bar is positioned between the handgrip 20 and the first support element 45. The motion of the slide bar is supported by the surfaces of the three openings, in the front, rear and intermediate portions of the support assembly. Such multiple support of the slide bar greatly enhances stability of the clamping operation. If desired, additional support of the sliding bar can be provided by making first cavity 28 solid except an opening adapted to receive the slide bar in the same manner as openings 25 and 27. In fact, with such a construction, the openings 25 and 27 would in reality be one long opening.

A trigger handle 24 is pivotably mounted to the support assembly 18 by means of a pivot pin or connection 26. For illustrative purposes this pivotal connection is shown to be positioned in the vicinity of the intermediate member 47. However, any suitable location of the pivotal connection is within the scope of the invention.

As a result of pivotal motion, at least a part of the trigger handle 24 extends into a first cavity 28 of the support assembly. This first cavity is limited by the handgrip 20, the front portion 41 and the intermediate portion 47. A second cavity 30 is situated between the handgrip 20, the intermediate 47 and rear 43 portions.

A driving lever 32 is located and/or suspended on the slide bar 14 which passes through a hole 34 in the driving lever 32. A compression spring between the driving lever 32 and a surface 38 of the cavity 30 urges the driving lever 32 against the rear end 40 of the trigger handle 24. At least the rear end 40 of the trigger handle 24 is suitably in the form of a fork so as to straddle the intermediate member 47 and the slide bar 14. Force of the spring 36 urges the trigger handle 24 against a limit stop 42 on an inner surface of the body 19 thus providing a standby condition. In the standby condition, the driving lever 32 is positioned substantially perpendicular to the direction of motion, indicated by the arrow 44, of the slide bar 14 when in operation. Motion of the trigger handle 24 about the pivot pin 26 in the direction of an arrow 17 moves the slide bar 14 against the bias of the spring 36.

Figure 10:
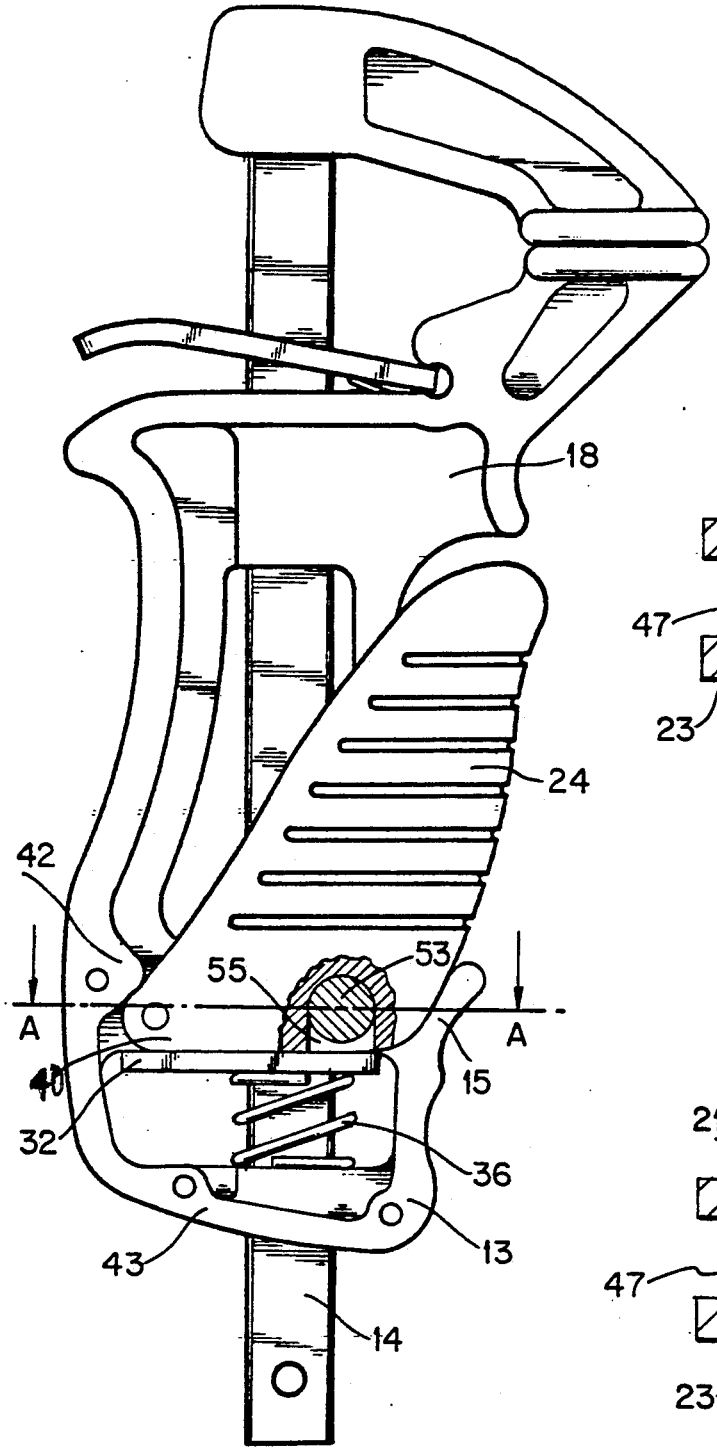
FIG. 10 is an elevational view of a modified embodiment of the hand tool.
Figure 11:
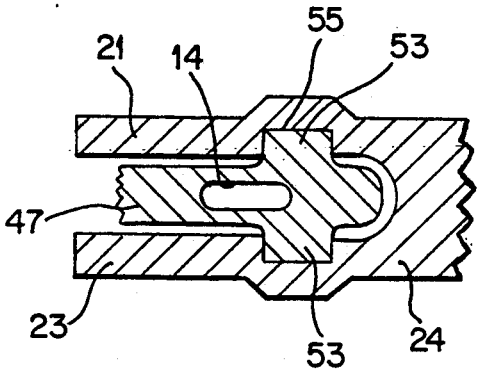
FIG. 11 is a cross-sectional view according to sectional line A—A of FIG. 10.
Figure 12:
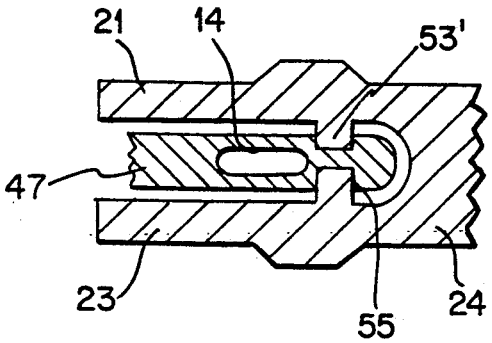
FIG. 12 is a partial cross-sectional view of a further embodiment of the hand tool.

FIGS. 10–12 illustrate an alternative connection between the trigger handle 24 and the support assembly 18. In the embodiment of FIGS. 10 and 11, sides 21 and 23 of the trigger handle are provided with channels 55 extending from an exterior of the rear end 40 into the body of the trigger. The intermediate member 47 or any other suitable part of the support assembly is provided with projections 53 which are adapted to be received within the channels 55. FIG. 12 shows the connection between the trigger handle and the support assembly in which the channels 55 are situated in the intermediate member 47 or any suitable part of the support assembly and the protrusions 53 extend from inside surfaces of the sides 21 and 23.

In the standby condition of the hand tool (see FIG. 10), the rear end 40 of the trigger handle engages the limit stop 42, the driving lever 32 and extension 15 of a connecting element 13. Compression of the spring 36 urges the driving lever 32 and the trigger handle against the stop 42. The above discussed engagement between the protrusions and channels ensures proper pivotal connection between the trigger handle and the support assembly.

The arrangement illustrated in FIGS. 10–12 facilitates the process of assembly of the hand tool in general and specifically simplifies positioning of the trigger handle within the tool.

The slide bar 14 passes through opening 48 in the braking lever 46. One end 50 of the braking lever 46 is pivotably positioned in a recess 52 such that the braking lever 46 may pivot within constraints defined by the surfaces of the recess 52 and by binding of the braking lever 46 with the slide bar 14 when the edges of the opening 48 in the lever 46 engage the end surfaces of the slide rod 14. As best illustrated in FIG. 1 the recess 52 is situated in the vicinity of the junction between the front portion 41 and the fixed jaw 22. At least one compression spring 54 is seated in a recess 56 in the body 19 and biases the free end of the braking lever 46 away from the front portion 41. The biased position of the braking lever 46 is limited by the binding and/or cocking interference between the opening 48 of the lever 46 and the end surfaces of the slide bar 14.

In the embodiment illustrated in FIG. 1 the braking lever 46 extends in the direction of the handgrip from the recess 52, so that its first end or engaging portion 33 is remote from the recess and is suitably gripped by the thumb of the user.

Figure 5:
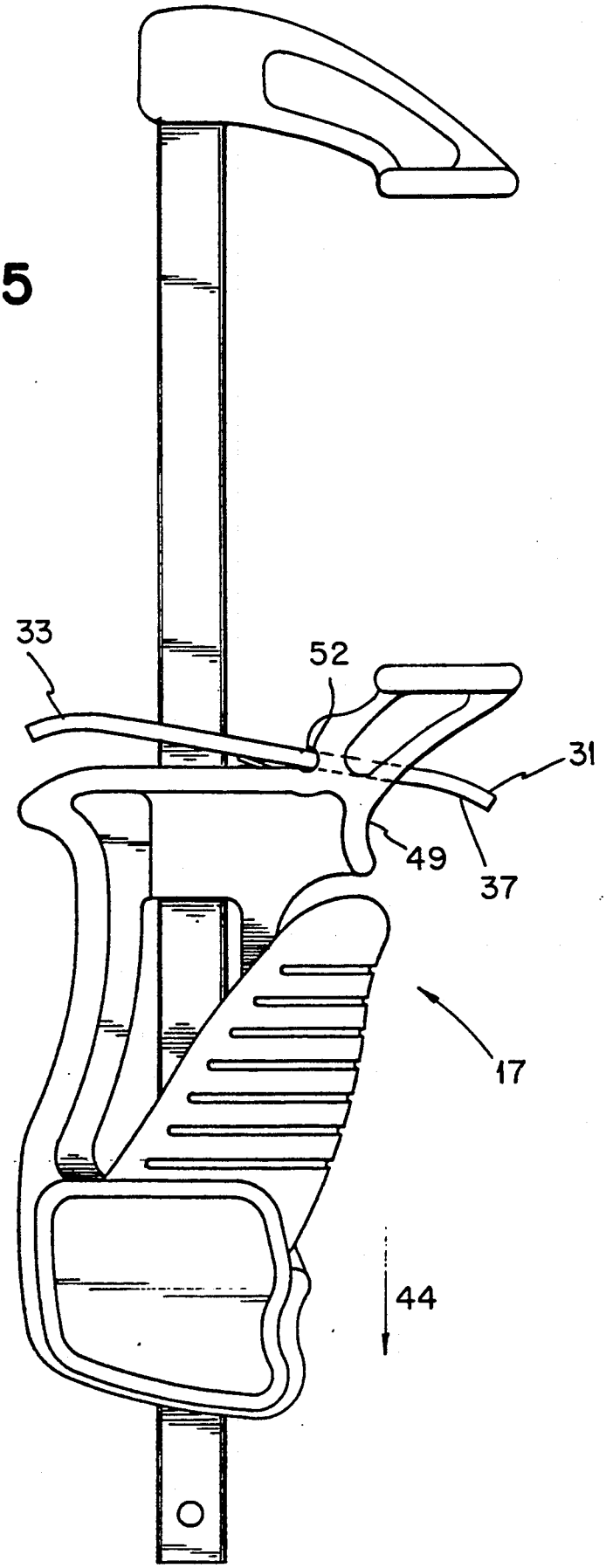
FIG. 5 is an elevational view showing another embodiment of the hand tool.

An alternative embodiment is shown in FIG. 5. There, the braking lever extends from the recess 52 in both directions. A second end 31 of the braking lever opposite to the end 33 passes through the body 19 of the support assembly and protrudes outwardly defining an engaging surface 37 for activation by the index finger of the user. If desired, both embodiments as shown in FIG. 5 may be present and one can use either as is convenient or the bar clamp may utilize one alternative. Note that in one case, the thumb is pressing down on the braking lever, and in the other case, the index finger is pressing it up.

It should be noted that in the standby position illustrated in FIG. 1, the driving lever 32 is substantially perpendicular to the longitudinal axis A—A of the slide bar 14, whereas the portion of the braking lever 46 which engages the slide bar 14 is transversely oriented to the longitudinal axis of the bar 14 at a slight angle. In this condition, if a force is applied to the moving jaw 12 in the direction indicated by the arrow 44, the slide bar 14 is free to move through all the openings of the support assembly 18. Because the braking lever 46 is free to pivot against the bias of the spring 54 when force is applied on the moving jaw 12 in the direction of the arrow 44, the braking lever 46 presents no obstacle to this motion of the slide bar and the moving jaw 12 may be advanced continuously toward the fixed jaw 22.

However, in the standby position as illustrated in FIG. 1, if a force is applied to the movable jaw 12 in the direction opposite to the direction indicated by the arrow 44, the end edges of the opening 48 in the lever 46 bind against the end surfaces of the slide bar 14 and it is not possible to withdraw the moving jaw further away from the fixed jaw 22. Compression of the spring 54 by pressing on the braking lever 46 with a finger in the direction of the arrow 44, allows withdrawal of the slide bar 14 and its movable jaw 12 to be extended away from the fixed jaw 22. Compression of the spring 54 brings the end 33 of the lever 46 into perpendicularity with the direction of intended motion of the slide bar 14, and thus the slide bar 14 is then free to slide in either direction through the opening 48 in the braking lever 46.

The trigger handle 24 is squeezed in the direction indicated by the arrow 17 (toward the slide bar) to incrementally advance the slide bar 14 with the movable jaw 12 toward the fixed jaw 22. When the trigger handle 24 is squeezed between a user's hand (not shown) and the handgrip 20, pivoting occurs about the pivot pin 26 and the rear end 40 of the trigger handle 24 also pivots and moves substantially in the direction of the arrow 44. This causes the driving lever 32 to pivot about its first end 35, so that the driving lever 32 is no longer perpendicular to the direction 44 of intended motion of the slide bar 14. Pivoting the driving lever 32 compresses the spring 36 and also causes the end edges of the hole 34 through the driving lever 32 to bind against the end surfaces of the slide rod 14. Binding occurs because the driving lever 32 is no longer perpendicular to the direction 44 of intended motion of the slide bar 14. Further motion of the trigger handle 24 causes the driving lever 32 to translate in the direction of the arrow 44. This motion further compresses the spring 36 and in the process, by means of the binding and/or cocking interference between the lever 32 and bar 14, advances the bar 14 and its connected movable jaw 12 toward the fixed jaw 22. The maximum distance of advance of the movable jaw 12 with one stroke of the trigger handle 22 is limited when the spring 36 is fully compressed or the handle 24 strikes the inner surface 58 of the body 19.

However, the stroke of the trigger handle 24 can be through any lesser arc, thereby diminishing the distance the movable jaw 12 travels in a single stroke in proportion to the angle of the trigger handle stroke. Additional strokes may be applied to the trigger handle 42 of any magnitude until the jaws 12, 22 come together, or a workpiece (not shown) is firmly gripped between them.

After the trigger handle 24 is fully pivoted in the direction of the arrow 17 about the pivot pin 26, release of the trigger handle 24 causes the return of the trigger handle 24, driving lever 32 and spring 36 to the position shown in FIG. 1 as a result of the compressive forces in the spring 36 urging the components toward the movable jaw 12.

A transverse pin or a stop 60 passing through the free end of the slide bar 14 prevents withdrawal of the slide bar 14 from the slot 16 when the braking lever 46 is pressed in the direction of the arrow 44 and the movable jaw 12 is manually drawn away from the fixed jaw 22. It should be noted that operation of the trigger handle 24 is ineffective in accomplishing any motion of the slide bar 14 in the direction opposite to the arrow 44.

Protective pads and/or specialty pads (not shown) can be attached to the jaws 12 and 22. The moving jaw 12 is held to the slide bar 14 by any conventional means, such as press fit, welding, rivet or pin, adhesives, etc. In the illustrated embodiment (FIG. 1) in accordance with the invention, the slide bar 14 has a rectangular cross-section. In alternative embodiments in accordance with the invention, the slide bar 14 may be any shape, for example, square, round, triangular, and the openings 34, 48 in the levers 32, 46, respectively as well as the openings 25, 27 and 29 of the support assembly would be appropriately shaped for their respective proper binding interference and alignment with the slide bar 14.

In summary, if it is desired that a workpiece is to be held between the jaws 12, 22, the movable jaw 12 can be advanced toward the fixed jaw 26 reducing a gap therebetween either in one continuous motion, merely by pushing in the direction of the arrow 44 on the movable jaw 22 or, by operating the trigger handle 24 in a series of strokes of length to be determined by the user. Large strokes may be used at first and small strokes later as the desired pressure is applied to the workpiece. During this advancing operation, the braking lever 46 prevents any backward motion (in the direction opposite to the arrow 44) of the slide bar 14 after each advance has been completed. While the braking lever 46 holds the bar 14, the trigger handle 24 is released. The spring 36 then returns the handle 24 and driving lever 32 to the positions shown in FIG. 1, ready for another stroke. At any time when the user desires to retract the movable jaw 12 away from the fixed jaw 22, for example, to release a workpiece or to open the bar clamp to receive a workpiece, it is only necessary to pull the movable jaw 12 in the direction opposite to the arrow 44 while simultaneously compressing the spring 54 by pressing on the first engaging part 33 of the braking lever 46 in the direction of the arrow 44.

It should be noted that the operation of the trigger handle 24 and braking lever 46 can be accomplished by the same hand while holding the bar clamp 10 with that hand.

In the preferred embodiment illustrated in FIG. 1 the thumb is typically positioned on the first end or engaging part 33 of braking lever 46, the other fingers encircle the trigger handle 24 while the handle 20 is contained by the palm of the same hand.

For general handling and holding of the hand tool, where one does not desire to hold-activate the trigger which could lead to inadvertent actuation and advancement of the movable jaw 12, first 49 and second 61 engagement areas are provided for one's fingers .

The embodiment shown in FIG. 5 can be operated as described hereinabove. However, when necessary the second end 31 with the engaging part 37 can be used. In such situation, to accomplish one hand operation, the index finger is positioned within the first engaging area 49 to actuate the braking lever 46 by pressing the second engaging part 37 in the direction opposite to the arrow 44. The other fingers encircle the trigger handle 24 while the handgrip 20 is contained in the palm of that hand.

As best illustrated in FIGS. 1-12, the overall quick action bar clamp 10 in accordance with the invention is basically flat, takes little space, and can be operated in tight places. Slide bars 14 of different lengths may be used.

Figure 6:
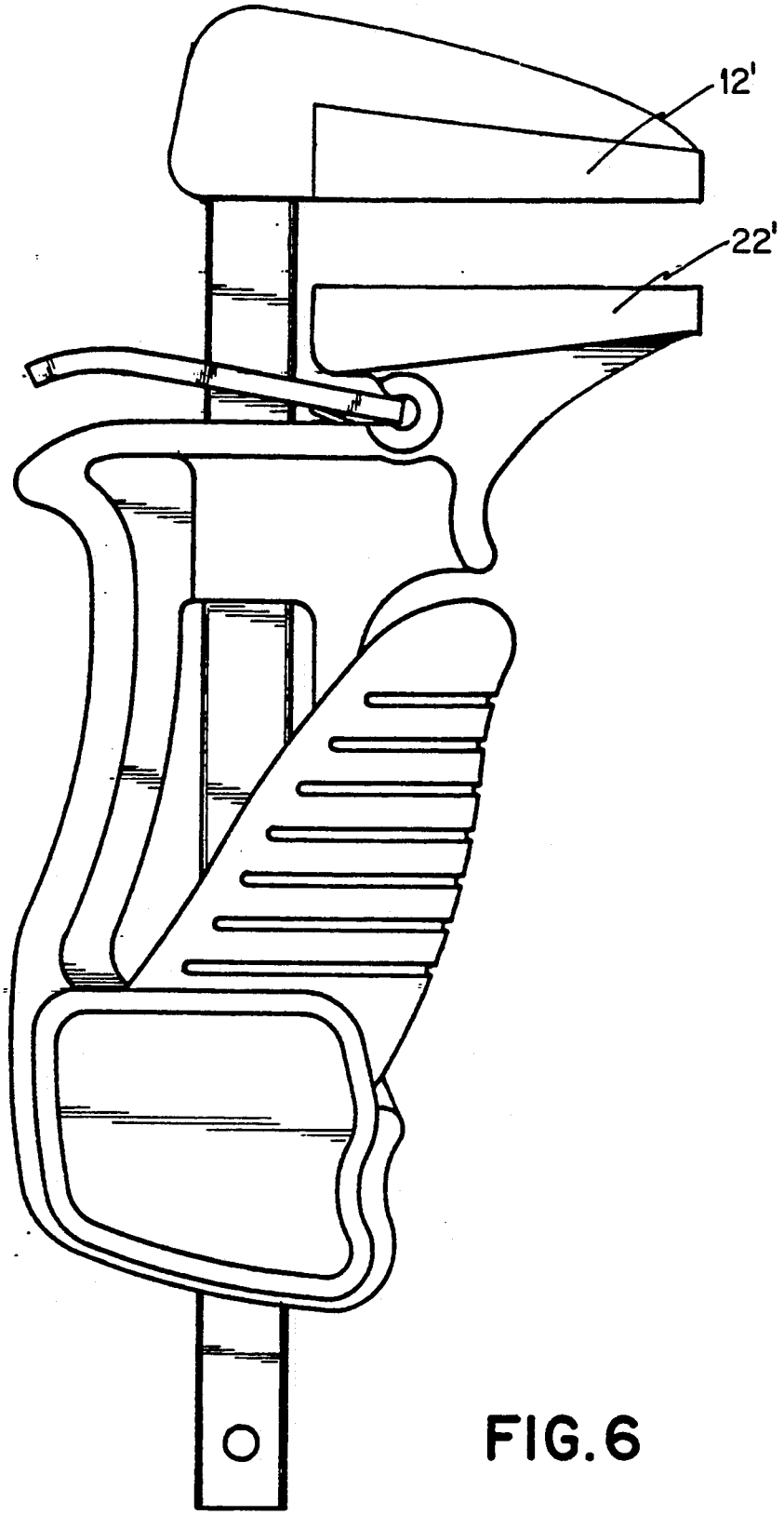
FIG. 6 is an elevational view of a further embodiment of the hand tool.

Grip of a workpiece by the jaws is quite strong so the hand tool of the invention can be used as a wrench. In this and other applications, in order to provide additional engagement with a workpiece, engaging surfaces of the movable jaw 12' and fixed jaw 22' can be extended as best shown in FIG. 6.

When the hand tool is used as a wrench, after a workpiece such as a nut, bolt, etc., is set between the jaws, a torque rotating the workpiece is applied by a user to the support assembly.

Figure 7:
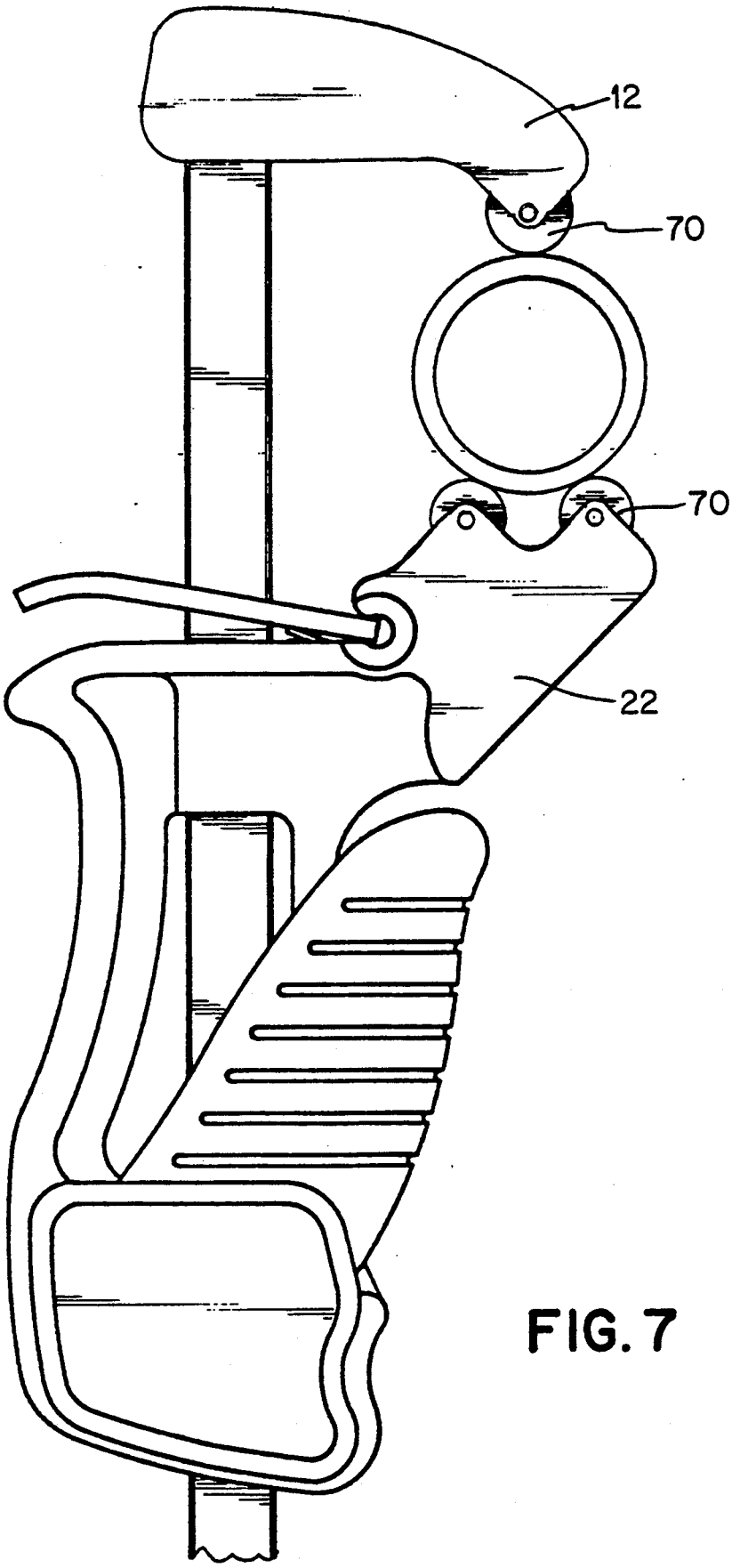
FIG. 7 is an elevational view of the hand tool used as a cutter.

FIG. 7 illustrates an embodiment of the invention adapted for use as a cutter. For this purpose, a plurality of cutting members is mounted on the jaws as shown, or alternatively a single cutter may be employed opposite a pair of rollers (not shown).

In the embodiment of the cutter shown in FIG. 7, one substantially circular cutting element 70 is rotatably mounted to the movable jaw 12 and two similar cutting elements are mounted to the fixed jaw 22.

Figure 8:
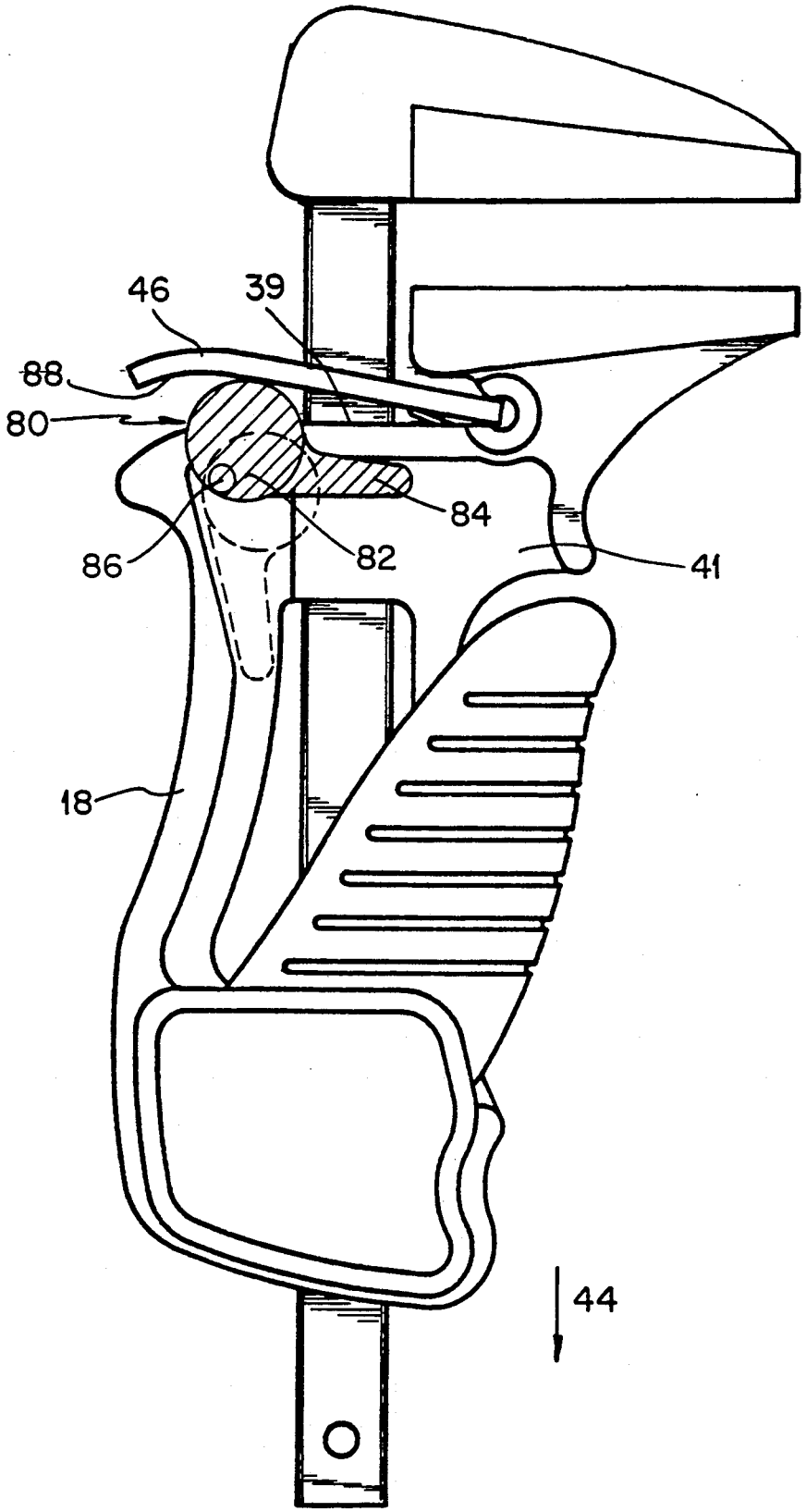
FIG. 8 is a view of the hand tool showing a locking mechanism.

In order to avoid inadvertent actuation of the braking lever, suitable locking means or a locking mechanism (as best illustrated in FIG. 8) can be provided at the support assembly 18. This mechanism consists of a cam 82 concentrically rotated about an axial pin 86. A handle part 84 extends outwardly from the cam and facilitates its rotation.

In the locked position of the mechanism, illustrated by solid lines in FIG. 8, the cam 82 protrudes beyond an outside surface 39 of the front part 41 of the support assembly and engages inside surface 88 of the braking lever 46. Such engagement prevents the braking lever from being inadvertently activated by pressing it in the direction of the arrow 44.

In the unlocked condition which is shown in FIG. 8 by phantom lines, the cam 82 does not extend beyond the surface 39 in the direction opposite to that of the arrow 44. Therefore, there is no obstacle for the braking lever to travel when it is pressed by fingers of a user.

In the embodiment of FIG. 1 the movable jaw 12 and the fixed jaw 22 are positioned on one side of the support assembly 18 and face each other. Therefore, activation of the driving lever 32 by the trigger handle 24 moves the slide bar 14 and the jaw 12 in the direction of the fixed jaw.

Figure 9:
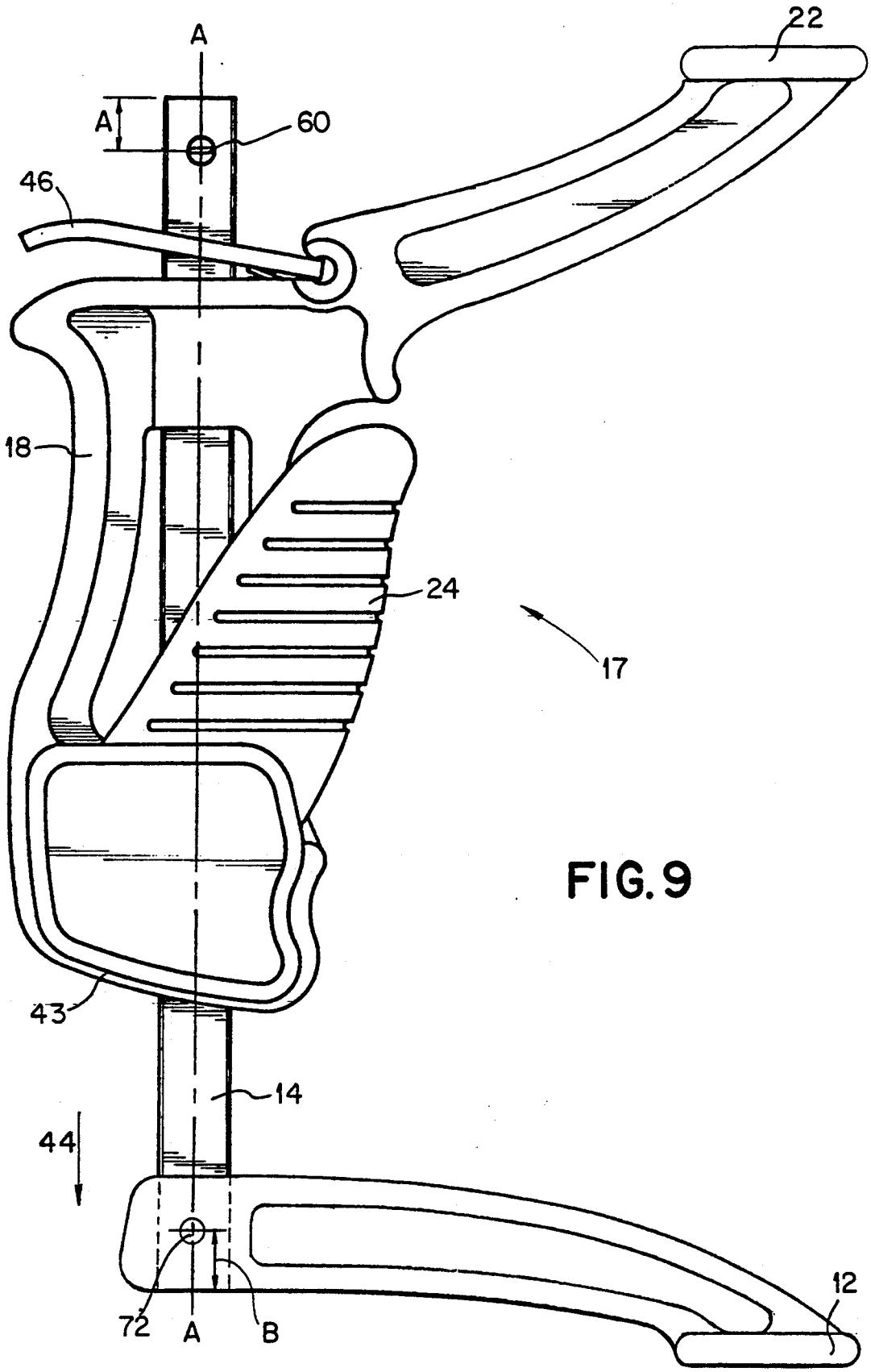
FIG. 9 is an elevational view of still another embodiment of the hand tool.

A modified hand tool having the fixed jaw 22 and movable jaw 12 facing in opposite directions and extending from opposite sides of the support assembly 18 is best shown in FIG. 9. In this embodiment the slide bar is inserted into the support assembly in such a way that the stop 60 positioned at one end thereof faces the braking lever 46 and the movable jaw 12 positioned at the other end of the slide bar faces the rear portion 43 of the support assembly.

In operation of this embodiment, when the trigger handle 24 is squeezed in the direction of the arrow 17 (toward the slide bar) it activates the driving lever (not shown in FIG. 9) and incrementally advances the movable jaw 12 connected to the slide bar 14 away from the fixed jaw 22.

In the standby position, shown in FIG. 9, the braking lever 46 engaging the slide bar 14 is transversely oriented to the longitudinal axis A—A at a slight angle. If a force is applied to the movable jaw in the direction of the arrow 44, the braking lever 46 presents no obstacle to the motion of the slide bar. However, if a force is applied to the movable jaw 12 in the direction opposite to the direction of the arrow 44, the engagement of the lever 46 and the surfaces of the slide bar 14 makes it impossible to move the movable jaw 12 in the direction of the fixed jaw 22.

If it is desired that a workpiece is to be spread apart by the jaws 12 and 22, the movable jaw 12 is advanced away from the jaw 22 by activation of the trigger handle and driving lever.

Typically, the movable jaw is permanently mounted at one end of the slide bar, whereas the stop is fixedly positioned at the other end. However, if desired the movable jaw 12 can be connected to the slide bar by means of a screw 72 or by any other suitable fastening means. The stop 60 can also be attached to the slide bar by a thread or any other conventional means to facilitate its removal and/or replacement.

In this case, the hand tool shown in FIG. 1 having jaws facing each other can easily be converted into the hand tool illustrated in the embodiment of FIG. 9 with the jaws facing in opposite directions.

In order to convert the tool, the screw connecting the movable jaw to the slide bar is loosened and the jaw removed from the bar.

Then, the stop is likewise released and taken out. The movable jaw 12 is then positioned on the bar as illustrated in FIG. 9 and the screw 72 tightened into the threaded opening in the slide bar to ensure permanent fixation. The stop 60 is then threaded into an opening in the slide bar facing the braking lever. In this case, the threads of the openings in the slide bar which are adapted for the attachment of the removable jaw 12 and the stop 60 are compatible and generally positioned at equal distances (A and B) from the corresponding ends of the slide bar.

We claim:

1. A hand tool comprising:

a fixed jaw;

a movable jaw;

a slide bar, said movable jaw being mounted to said slide bar;

support means for supporting said slide bar; said fixed jaw extending outwardly from said support means and having at least a front portion facing said movable jaw, said support means having a handgrip extending longitudinally along said slide bar;

receiving means in the vicinity of the junction between said front portion of the fixed jaw and said support means, a braking lever pivotable at said receiving means and having an engaging portion extending outwardly from said support means, one-way drive means for releasably engaging and, when engaged, for advancing said slide bar and movable jaw, said one-way drive means having at least a driving lever; and a trigger handle pivotably mounted at said support means and contacting said driving lever, said trigger handle having a gripping portion extending longitudinally along said slide bar.

2. A hand tool as claimed in claim 1, wherein a longitudinal axis of said slide bar is substantially parallel to a longitudinal axis of said support means.

3. A hand tool as claimed in claim 1, wherein said support means comprises front and rear parts and said handgrip connects one side of said front and rear parts.

4. A hand tool as claimed in claim 3, wherein said front part has a first opening and said rear part has a second opening, said openings are adapted to receive said slide bar, said longitudinal axis of said support means passes through said first and second openings.

5. A hand tool as claimed in claim 4, wherein said support means further comprises a first support element spaced from said handgrip and connecting the other side of said front and rear parts.

6. A hand tool as claimed in claim 5, wherein said first support element is substantially parallel to the longitudinal axis of said support means.

7. A hand tool as claimed in claim 5, wherein said support means further including a second support member extending transversely to said handgrip and the first support member and a third opening for receiving said slide bar is provided within said second support member.

8. A hand tool as claimed in claim 7, wherein axes of the first, second and third openings coincide the longitudinal axis of the support means.

9. A hand tool as claimed in claim 8, wherein said slide bar passing through said first and second openings is positioned between said handgrip and said first support element.

10. A hand tool as claimed in claim 9, wherein said slide bar passes through the third opening.

11. A hand tool as claimed in claim 5, wherein a pivotal point of said trigger handle is positioned between said front and rear parts of said support means.

12. A hand tool as claimed in claim 1, wherein said support means has a forward portion facing said movable jaw and said engaging portion of the braking lever extends outwardly from the forward portion.

13. A hand tool as claimed in claim 1, wherein the trigger handle and braking lever being operable selectively by the same hand in such a manner that the thumb is positioned on the engaging portion of the braking lever to actuate the braking lever, while other fingers encircle the trigger handle.

14. A hand tool as claimed in claim 1, wherein the clamp is operated in such a manner that the index finger is positioned under the engaging portion of the braking lever and pushing said braking lever in the direction of the movable jaw for actuation, while other fingers encircle the trigger handle.

15. A hand tool as claimed in claim 1, wherein said movable and fixed jaws have engaging surfaces extending in the direction transverse to the slide bar facilitating use of the hand tool as a wrench.

16. A hand tool as claimed in claim 1, wherein cutting elements are provided at said movable and fixed jaws.

17. A hand tool as claimed in claim 1, wherein locking means is provided at said support assembly to prevent inadvertent actuation of the braking lever.

18. A hand tool as claimed in claim 1, wherein said movable and fixed jaws have engaging surfaces for engaging a workpiece; said engaging surfaces of the movable jaw facing the direction opposite to that of the fixed jaw.

19. A hand tool as claimed in claim 1, wherein said movable jaw is mounted to an end of the slide bar remote to the braking lever.

20. A hand tool comprising:

a fixed jaw;

a movable jaw opposing said fixed jaw;

a slide bar, said movable jaw being mounted on one end of said slide bar, said slide bar being movable to bring said movable jaw toward and away from said fixed jaw;

support means for supporting said slide bar, said fixed jaw being mounted to said support means, said support means having a handgrip extending longitudinally along said slide bar;

one-way drive means for releasably engaging and, when engaged, for advancing said slide bar and attached movable jaw, said one-way drive means having a driving lever, and a braking lever normally engaging said slide bar, said braking lever when engaging said slide bar preventing motion of said movable jaw away from said fixed jaw, and when disengaging said slide bar allowing advancement of said movable jaw away from said fixed jaw;

a trigger handle pivotably mounted to said support means and contacting said driving lever, said trigger handle having a gripping portion extending longitudinally along said slide bar, whereby reciprocal motion of at least said gripping portion of the trigger handle toward and away from said slide bar resulting in said driving lever engaging and moving said slide rod and said movable jaw toward said fixed jaw.

* * * * *

UNITED STATES PATENT AND TRADEMARK OFFICE

CERTIFICATE OF CORRECTION

PATENT NO. : 5,005,449

DATED : April 9, 1991

INVENTOR(S) : Joseph A. Sorensen; Dwight L. Gatzemeyer

It is certified that error appears in the above—identified patent and that said Letters Patent is hereby corrected as shown below:

In the title page the Assignee should read:

Peters[o]en Manufacturing Co., Inc.,

Column 7, Claim 1, Lines 50 and 51 should read:

... and having at least a front portion [facing said movable jaw], said support means having a handgrip ...

Signed and Sealed this

Sixth Day of July, 1993

Michael K. Kirk

MICHAEL K. KIRK

*Acting Commissioner of Patents and Trademarks*

*Attest:*

*Attesting Officer*